United States Patent [19]

Yamaki

[11] Patent Number: 4,709,309

[45] Date of Patent: Nov. 24, 1987

[54] ELECTRIC FLASHLIGHT

[75] Inventor: Masahiko Yamaki, Sumida, Japan

[73] Assignee: Seikosha Co., Ltd., Tokyo, Japan

[21] Appl. No.: 898,327

[22] Filed: Aug. 20, 1986

[30] Foreign Application Priority Data

Aug. 20, 1985 [JP] Japan ..... 60-126831[U]

[51] Int. Cl.[4] ..... F21L 7/00

[52] U.S. Cl. ..... 362/199; 362/198; 362/202

[58] Field of Search ..... 362/191, 197, 198, 199, 362/202, 203, 205

[56] References Cited

U.S. PATENT DOCUMENTS

| | | | |
|---|---|---|---|
| 1,807,129 | 5/1931 | Nuckolls | 362/199 |
| 2,494,886 | 1/1950 | Leif | 362/199 |
| 2,933,844 | 4/1960 | Seigle | 362/203 |

*Primary Examiner*—Stephen F. Husar

*Attorney, Agent, or Firm*—Bruce L. Adams; Van C. Wilks

[57] ABSTRACT

An electric flashlight with removable front cover is provided with a pivotal battery keeper mounting the light bulb, the socket for the light bulb, and a battery contact of the flashlight. The battery keeper pivots about a hinge portion so that the batteries can be changed without the possibility of losing or damaging any parts, such as the light bulb, thereby improving the procedure for changing batteries in the flashlight.

6 Claims, 2 Drawing Figures

ELECTRIC FLASHLIGHT

The present invention relates to an electric torch or flashlight.

Conventionally an electric torch or flashlight has been suggested in which a battery holder is provided in the central portion of the flashlight. Such apparatus typically includes a front cover provided with a battery contact, a socket, a lamp or light bulb, a reflector and a transparent glass cover the front cover being screwed to the front portion of the flashlight and a rear cover provided with a minus or negative contact is screwed to the rear end portion of the flashlight.

Such conventional electric flashlight has a shortcoming in that when the front cover is removed for changing batteries, the lamp or other part may be erroneously dropped and broken, or may be lost.

One object of the present invention is to provide an electric flashlight in which the batteries can be changed by opening a front cover without the possibility of losing any parts, thereby improving the battery change procedure.

The above object, other objects and characteristic features of the present invention will become more evident and will be more readily understood from the following description and claims taken in conjunction with the accompanying drawings, in which;

Figure 1:
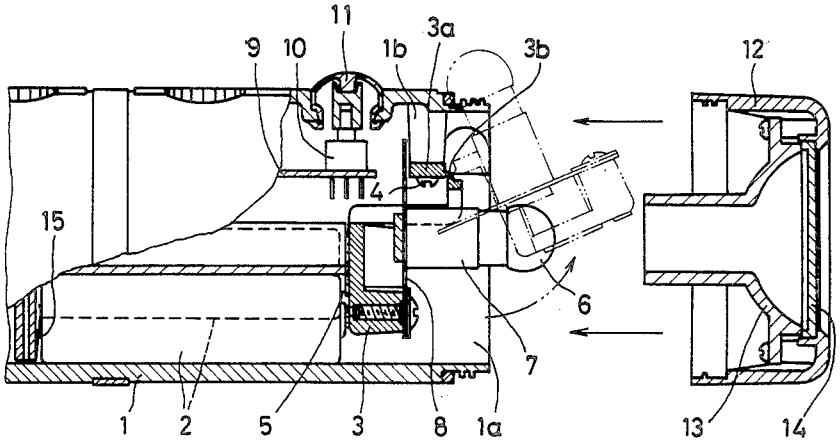
FIG. 1 is a sectional view of an embodiment according to the present invention.
Figure 2:
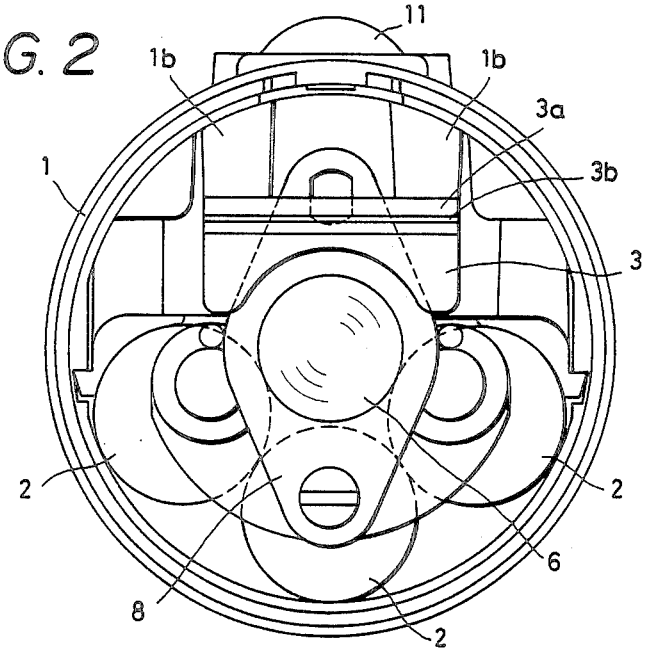
FIG. 2 is an enlarged right end view with the front cover removed.

Referring now to the drawings, an embodiment of the present invention will be described.

A battery holder 1 is provided with an opening 1*a* at its front end portion. Batteries 2 are mounted in the battery holder 1 through the opening 1*a*. The battery holder 1 is provided with a pillar 1*b* to which a battery keeper 3 is secured by screws 4 at its attaching portion 3*a*. The battery keeper member 3 is rockably or pivotally supported at the hinge portion 3*b*. A battery contact 5 is secured to the inside of the battery keeper member 3. A socket 7 for a light bulb or lamp 6 is secured to an attaching plate 8.

A switch 10 for connecting or breaking the circuit between the lamp 6 and the batteries is mounted on a circuit board 9. By pushing a button 11, the switch 10 is turned on or off. A front cover 12 is provided with a reflector 13 and a transparent lamp cover 14. The front cover 12 is screwed onto the battery holder 1. The innermost portion of the reflector 13 abuts against the attaching plate 8 thereby pushing the battery contact 5 against a plus or positive terminal of the batteries 2. A battery contact 15 contacts a minus or negative terminal of the batteries 2.

In case of changing batteries, the cover 12 is first removed and the battery keeper member 3 is pivoted and opened to the position shown in phantom lines in FIG. 1, and the batteries 2 can thereby be easily taken out through the opening 1*a*. After changing batteries, the battery keeper member 3 is pivoted and returned to its original position shown in solid lines in FIG. 1 and the battery contacts 5 contact the terminals of the batteries. Then front cover 12 is screwed back onto the opening 1*a* of the battery holder 1 to push against the attaching plate 8 by means of the end portion of the reflector 13 and the battery contact 5 thus contacts the batteries 2.

As described above, the changing of batteries can be easily performed by opening the front cover. Since the battery contact, the lamp and the like are secured to the battery keeper member in one unit, there is no fear of coming off or losing any part when the front cover is opened. Further, since batteries can be changed through the front opening, a timepiece or the like can be mounted at the rear end portion of the electric flashlight.

What is claimed is:

1. In a battery-operated electric flashlight: a tubular casing having an open front end portion and having means therein for releasable holding a set of replaceable batteries during use of the flashlight; pivotable battery keeping means pivotably mounted within the casing at the front end portion thereof for pivotal movement to a first position wherein the battery keeping means engages with the set of batteries to hold the same in the casing and to a second position wherein the battery keeping means is sufficiently clear of the set of batteries so as to permit removal and replacement of the batteries through the open front end of the casing; and a front cover detachably connected to the casing front end portion, the front cover having means for maintaining the battery keeping means in the first position when the front cover is connected to the casing.

2. A battery-operated electric flashlight according to claim 1; wherein the battery keeping means has a flexible constricted portion extending transversely of the casing to define a pivot line about which the battery keeping means pivots.

3. A battery-operated electric flashlight according to claim 2; wherein the battery keeping means has mounted thereon at the rear side thereof a battery contact for making the electrical connection with the terminals of the set of batteries when the battery keeping means is in the first position and has mounted thereon at the front side thereof a socket for an electric light bulb.

4. A battery-operated electric flashlight according to claim 3; wherein the front cover has a light bulb reflector, the light bulb reflector having a rearwardly extending tubular portion which encircles the socket when the front cover is connected to the casing, and the tubular portion having a rear end which presses rearwardly against the battery keeping means to maintain the same in the first position when the front cover is connected to the casing.

5. A battery-operated electric flashlight according to claim 1; wherein the battery keeping means has mounted thereon at the rear side thereof a battery contact for making electrical connection with the terminals of the set of batteries when the battery keeping means is in the first position and has mounted thereon at the front side thereof a socket for an electric light bulb.

6. A battery-operated-electric flashlight according to claim 5; wherein the front cover has a light bulb reflector, the light bulb reflector having a rearwardly extending tubular portion which encircles the socket when the front cover is connected to the casing, and the tubular portion having a rear end which presses rearwardly against the battery keeping means to maintain the same in the first position when the front cover is connected to the casing.

* * * * *